US012245725B1

(12) United States Patent
Wong

(10) Patent No.: US 12,245,725 B1
(45) Date of Patent: Mar. 11, 2025

(54) HOLDER FOR ROLLED PAPER PRODUCTS

(71) Applicant: Chun Kit Kendrick Wong, Hong Kong (HK)

(72) Inventor: Chun Kit Kendrick Wong, Hong Kong (HK)

( * ) Notice: Subject to any disclaimer, the term of this patent is extended or adjusted under 35 U.S.C. 154(b) by 93 days.

(21) Appl. No.: 18/233,983

(22) Filed: Aug. 15, 2023

(51) Int. Cl.
*A47K 10/38* (2006.01)

(52) U.S. Cl.
CPC .... *A47K 10/3836* (2013.01); *A47K 2010/389* (2013.01)

(58) Field of Classification Search
CPC ..... A47K 10/38; A47K 10/3836; A47K 2010/389
USPC ..... 242/597.7
See application file for complete search history.

(56) References Cited

U.S. PATENT DOCUMENTS 6,793,097 B2 * 9/2004 Kamenstein ..... B65H 16/005 221/33
2007/0194168 A1 * 8/2007 Yang ..... A47K 10/3836 242/597.7
2007/0210206 A1 * 9/2007 Nip ..... A47K 10/3836 242/597.7
2020/0146518 A1 * 5/2020 Kamenstein ..... A47K 10/3836
2020/0170459 A1 * 6/2020 Green ..... B65H 35/002
2023/0414046 A1 * 12/2023 Li ..... A47K 10/38
2024/0277190 A1 * 8/2024 Dunn ..... A47K 10/3836
2024/0374089 A1 * 11/2024 Yang ..... A47K 10/3836

* cited by examiner

*Primary Examiner* — William A. Rivera
(74) *Attorney, Agent, or Firm* — WPAT, PC

(57) ABSTRACT

The present invention relates to a holder, for rolled paper products, comprising: (a) a base member, comprising: i) a compartment; ii) a first receptacle, fixed to said compartment, comprising a central bore; iii) one spring disposed in said first receptacle and being coaxial with said central bore of said first receptable; iv) a disc disposed on said resilient member, comprising: at least one ramp protruding therefrom facing away said resilient member; and a central aperture being coaxial with said central bore of said first receptable; v) a rotation member having a complementary structure to the structure of said first receptacle, such that said rotation member fittingly assembling to said first receptacle can rotate with respect to said first receptacle, in which, said rotation member comprising: a central aperture superimposed to said central bore of said first receptacle, and a plurality of crests and troughs facing said ramp of said disc; vi) a stopper, partially received in said central bore of said first receptacle and said central aperture of said rotation member; vii) a fastener, for fastening said stopper to said first receptacle, wherein said stopper is profiled to maintain the assembled state of said rotation member to said first receptacle; and (b) a rod member, contacting said rotation member.

20 Claims, 18 Drawing Sheets

SECTION B-B

HOLDER FOR ROLLED PAPER PRODUCTS

FIELD OF THE INVENTION

The present invention is related to a holder for rolled papers. Specifically, the present invention is related to a standing holder for kitchen roll paper/kitchen roll towel, toilet roll paper/toilet roll towel.

BACKGROUND OF THE INVENTION

A paper roll holder is a device or fixture designed to hold and dispense paper rolls. It is commonly used in various settings such as kitchens, bathrooms, offices, and workshops. The primary function of a paper roll holder is to provide a convenient and organized way to dispense paper, typically in the form of paper towels, toilet paper, or other types of rolled paper products. Usually, these paper roll holders are provided with tension mechanisms within the holder, ensuring a controlled unwinding of the paper and allowing the user to use the desired amount while keeping the remaining paper securely in place. However, these tension mechanisms can only provide single resistance force and single response time against the unwinding of the rolled products which are commercially available in various types in terms of dimension, i.e., the length of the individual sheet to be torn off. It shall be understood that when these tension mechanisms work with rolled products in different dimensions, the resistance provided to oppose the unwinding action may be faster, slower, stronger, or weaker than required, the sheet of material to be torn may be broken off before it should have been torn along the dotted tear line.

The present invention seeks to address issues of these mechanisms lack capability to adjust its resistance force and response time, or at least to provide an alternative to the public.

SUMMARY OF INVENTION

In one aspect, the present invention is related to a holder, for kitchen roll paper, kitchen roll towel, toilet roll paper, or toilet roll towel, comprising:

- a base member, comprising:
  - a compartment;
  - a first receptacle, comprising:
    - a circumferential wall;
    - a central bore having an upper bore and a lower bore;
    - a first standing wall surrounding said central bore;
    - a second standing wall disposed between said first standing wall and said circumferential wall, wherein the position of said second standing wall defines a first cavity between said first standing wall and said second standing wall, and defines a second cavity between said second standing wall and said circumferential wall; and
    - a plurality of ridges extending away from said second standing wall, wherein each said ridges comprising a first end connecting said second standing wall and a second free end, the position of said second free end defines a spacing between said second free end and said circumferential wall;
  - one elastic spring, disposed on said ridges of said first receptacle and circulates around said second standing wall of said first receptacle, thereby said elastic spring can be compressed or relaxed in the longitudinal direction of said holder;

- a disc, comprising a ring-shaped plate and a plurality of ramps protruding therefrom, said disc is disposed on said elastic spring by passing the central cavity of said disc through said second standing wall of said first receptacle, wherein said plurality of ramps facing opposite said elastic spring;
  - a rotation member, comprising:
    - a hollow cup, having a top-plate connecting to a circumferential wall defining an open-bottom;
    - a hollow bushing extending through said top-plate of said hollow cup, such that an upper part of said hollow bushing is outwardly exposed from said top-plate of said hollow cup and a lower part of said hollow bushing is surrounded by said circumferential wall of said hollow cup;
    - wherein the underside of said top-plate of said hollow cup is provided with a plurality of crests and trough alternately arranged and radially formed continuously around said lower part of said hollow bushing; and
    - said rotation member is assembled to said first receptacle, wherein the lower part of said hollow bushing is received in said first cavity of said first receptacle, and that said circumferential wall of said hollow cup is received in said spacing of said first receptacle, thereby said rotation member rotatable with respect to said first receptacle;
  - a stopper, comprising a first portion received in said upper part of said hollow bushing and a second portion partially received in said upper bore of said first receptacle; and
  - a fastener, installed in said lower part of said hollow bushing, for fastening the assembly formed by said first receptacle, said rotation member, and said stopper; and
- a rod member, comprising a first rod, a second rod, and a connector connecting said first rod and said second rod, wherein said rod member engaging the upper part of said hollow bushing.

In a second aspect, the present invention is related to a holder, for rolled paper products, comprising:

- a base member, comprising:
  - a compartment;
  - a first receptacle, fixed to said compartment, comprising:
    - a first standing wall defining a central bore; and
    - a plateau;
  - a resilient member that can be biased along the longitudinal direction of said holder, disposed on said plateau of said first receptacle and being coaxial with said central bore of said first receptable;
  - a disc disposed on said resilient member and comprising a ring-shaped plate and at least one ramp protruding therefrom facing away said resilient member, said disc being coaxial with said central bore of said first receptable;
  - a rotation member, comprising a plate with a central aperture and having a complementary structure to the structure of said first receptacle such that said rotation member fittingly assemble to said first receptacle; in the assembly between said first receptacle and said rotation member:
    - said rotation member can be rotated with respect to said first receptacle;
    - said central aperture of said rotation member superimposed to said central bore of said first receptacle; and said plate of said rotation member separating from said plateau of said first receptacle defines an adjustable cavity for accommodating said resilient member and said disc, wherein said plate of said rotation member is provided with a plurality of crests and troughs facing said ramp of said disc;

a stopper, partially received in said central bore of said first receptacle and said aperture of said rotation member; and a fastener, for fastening said stopper to said first receptacle, wherein said stopper is profiled to maintain the assembled state of said rotation member to said first receptacle, and can be used to adjust said adjustable cavity defined by said plate of said rotation member and said plateau of said first receptacle; and a rod member, contacting said rotation member.

In one embodiment, said first receptacle further comprising a circumferential wall, said plateau disposed between said first standing wall and said circumferential wall, wherein the position of said plateau defines a first cavity between said first standing wall and said plateau, and defines a second cavity between said plateau and said circumferential wall.

Preferably, said plateau is formed by a second standing wall connecting a plurality of ridges, wherein:

said second standing wall disposed between said first standing wall and said circumferential wall;

the position of said second standing wall defines said first cavity between said first standing wall and said second standing wall, and defines said second cavity between said second standing wall and said circumferential wall; and said ridges extending away from said second standing wall.

In one embodiment, each said ridges comprising a first end connecting said second standing wall and a second free end, the position of said second free end defines a spacing between said second free end and said circumferential wall.

In one embodiment, said resilient member is one spring disposed on said ridges of said first receptacle and configured to circulate around said second standing wall of said first receptacle.

In one embodiment, said disc being coaxial with said central bore of said first receptable by passing the central cavity of said disc through said second standing wall of said first receptacle.

In one embodiment, the plurality of crests and troughs are alternately arranged and radially formed continuously around said central aperture of said rotation member.

In one embodiment, said rotation member comprising a hollow cup, defined by said plate connecting a circumferential wall defining an open bottom; and a hollow bushing extending through said plate of said hollow cup, such that an upper part of said hollow bushing is outwardly exposed from said plate of said hollow cup and a lower part of said hollow bushing is surrounded by said circumferential wall of said hollow cup.

Preferably, said rotation member is assembled to said first receptacle, wherein said lower part of said hollow bushing is received in said first cavity of said first receptacle, and that said circumferential wall of said hollow cup is received in said second cavity of said first receptacle.

More preferably, each said ridges comprising a first end connecting said second standing wall and a second free end, the position of said second free end defines a spacing between said second free end and said circumferential wall; said rotation member is assembled to said first receptacle, wherein the lower part of said hollow bushing is received in said first cavity of said first receptacle, and that said circumferential wall of said hollow cup is received in said spacing of said first receptacle.

In another embodiment, said stopper comprising a first portion and a second portion partially received in said central bore of said first receptacle and said aperture of said rotation member.

Preferably, said stopper comprising a first portion received in said upper part of said hollow bushing of said rotation member, and a second portion partially received in said central bore of said first receptacle and said aperture of said rotation member;

Advantageously, said fastener is installed in said second portion of said stopper, for fastening the assembly between said first receptacle, said rotation member, and said second receptacle.

More advantageously, said fastener is provided with a thread region engaging with said second portion of said stopper, wherein the longer the threaded region between said fastener and said second portion of said stopper engaging, the smaller the adjustable cavity defined by said plate of said rotation member and said plateau of said first receptacle.

In one embodiment, said rod member comprising: a first hollow rod; a second hollow rod, wherein the inner diameter of said second hollow rod is smaller than the inner diameter of said first hollow rod; a connector, comprising a first portion having sized and shaped to fit the internal cavity of said first hollow rod, and a second portion having sized and shaped to fit the internal cavity of said second hollow rod; wherein said connector and said second hollow rod are disposed inside the internal cavity of said first hollow rod, and said second hollow rod connected to said second portion of said connector.

Preferably, said second hollow rod is received by said stopper and said first hollow rod is received by said rotation member.

In one embodiment, said base member is provided with an auxiliary arm member having a stick and a pad, wherein said auxiliary arm member is configured to slant towards said rod member.

Preferably, said rod member can be equipped with an enhancer that can be sleeved over the outer surface of said rod member, wherein said enhancers is designed to provide a plurality of edges or ridges bulging outwards from the rod member and/or spirally circulating around said rod member.

In a third aspect, the present invention is related to a holder, for rolled paper products, comprising:

a base member, comprising:

a compartment;

a first receptacle, fixed to said compartment, comprising a central bore;

one spring disposed in said first receptacle and being coaxial with said central bore of said first receptable;

a disc disposed on said resilient member, comprising: at least one ramp protruding therefrom facing away said resilient member; and a central aperture being coaxial with said central bore of said first receptable;

a rotation member having a complementary structure to the structure of said first receptacle, such that said rotation member fittingly assembling to said first receptacle can rotate with respect to said first receptacle, in which, said rotation member comprising: a central aperture superimposed to said central bore of said first receptacle, and a plurality of crests and troughs facing said ramp of said disc;

a stopper, partially received in said central bore of said first receptacle and said central aperture of said rotation member; and a fastener, for fastening said stopper to said first receptacle, wherein said stopper is profiled to maintain the assembled state of said rotation member to said first receptacle; and a rod member, contacting said rotation member.

DESCRIPTION OF THE DRAWINGS

Some embodiments of the present invention will now be explained, with reference to the accompanied drawings, in which.

DETAILED DESCRIPTION OF PREFERRED EMBODIMENTS OF THE INVENTION

Figure 1:
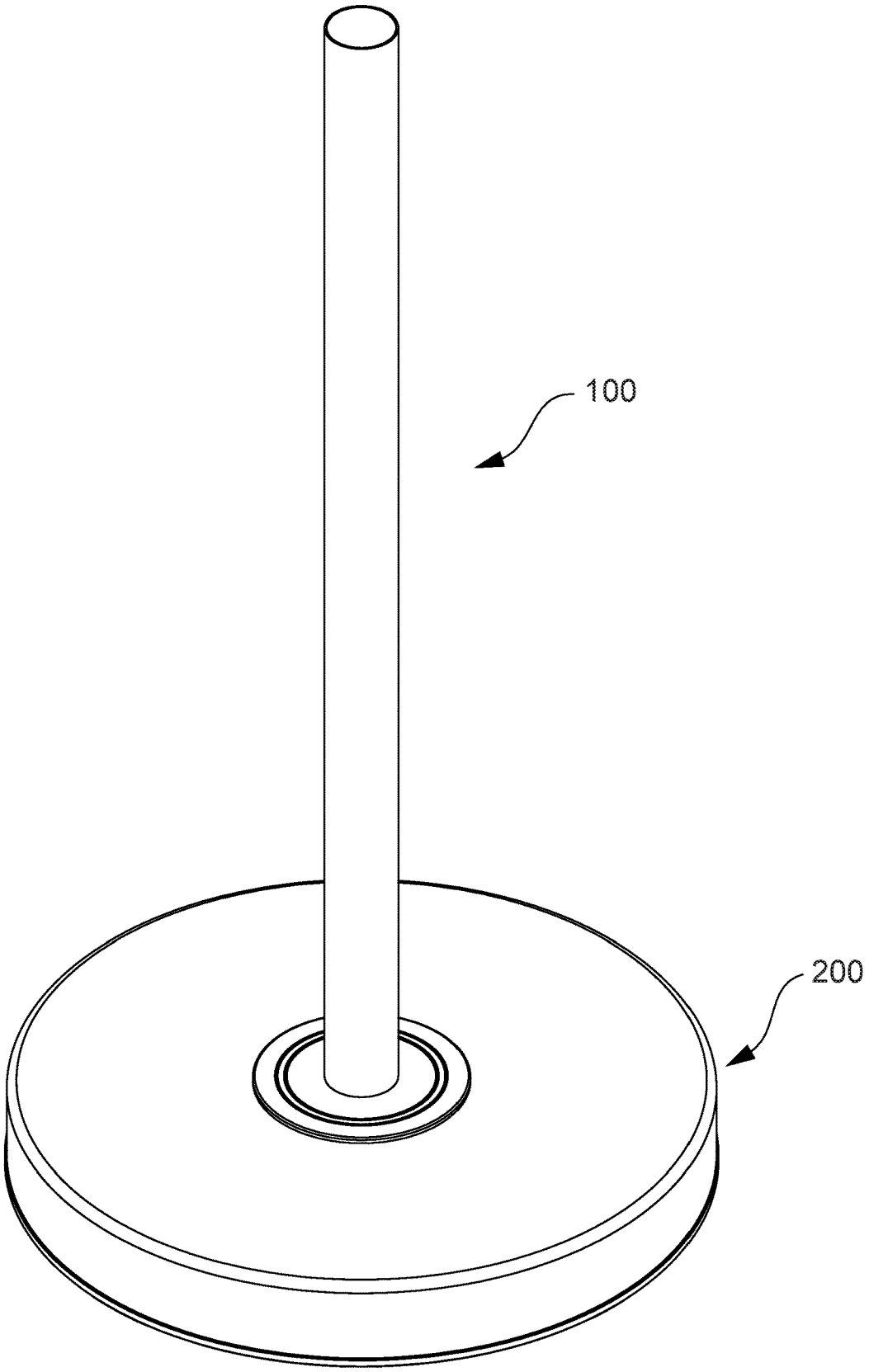
FIG. 1 shows a first embodiment of the present invention.

The present invention is now presented by way of examples with reference to the figures in the following paragraphs. Objects, features, and aspects of the present disclosure are disclosed in or are apparent from the following description. It shall be understood by one of ordinary skilled in the art that the following description is a description of exemplary embodiments only, and is not intended as limiting the broader aspects of the present disclosure, which broader aspects are embodied in the exemplary constructions.

It should be noted that, unless otherwise defined, the technical terms or scientific terms used in the embodiments of the present invention shall have the usual meanings understood by person with ordinary skills in the art to which the present invention belongs. "First", "second" and similar expression used in the embodiments of the present invention do not indicate any order, quantity or importance, but are only used to distinguish different components. "Front", "rear", "left", "right", "upper", and "lower" and other terms indicating orientation or similar terms are only described for the exemplary relative positional relationship shown in the drawings to facilitate the understanding. It does not limit the disclosed components in the present invention can only follow this specific relative positional relationship. "Connect or the like", "mount or the like" or "secure or the like" or "assemble or the like" is not limited to physical or mechanical connections, whether direct or indirect.

Figure 2:
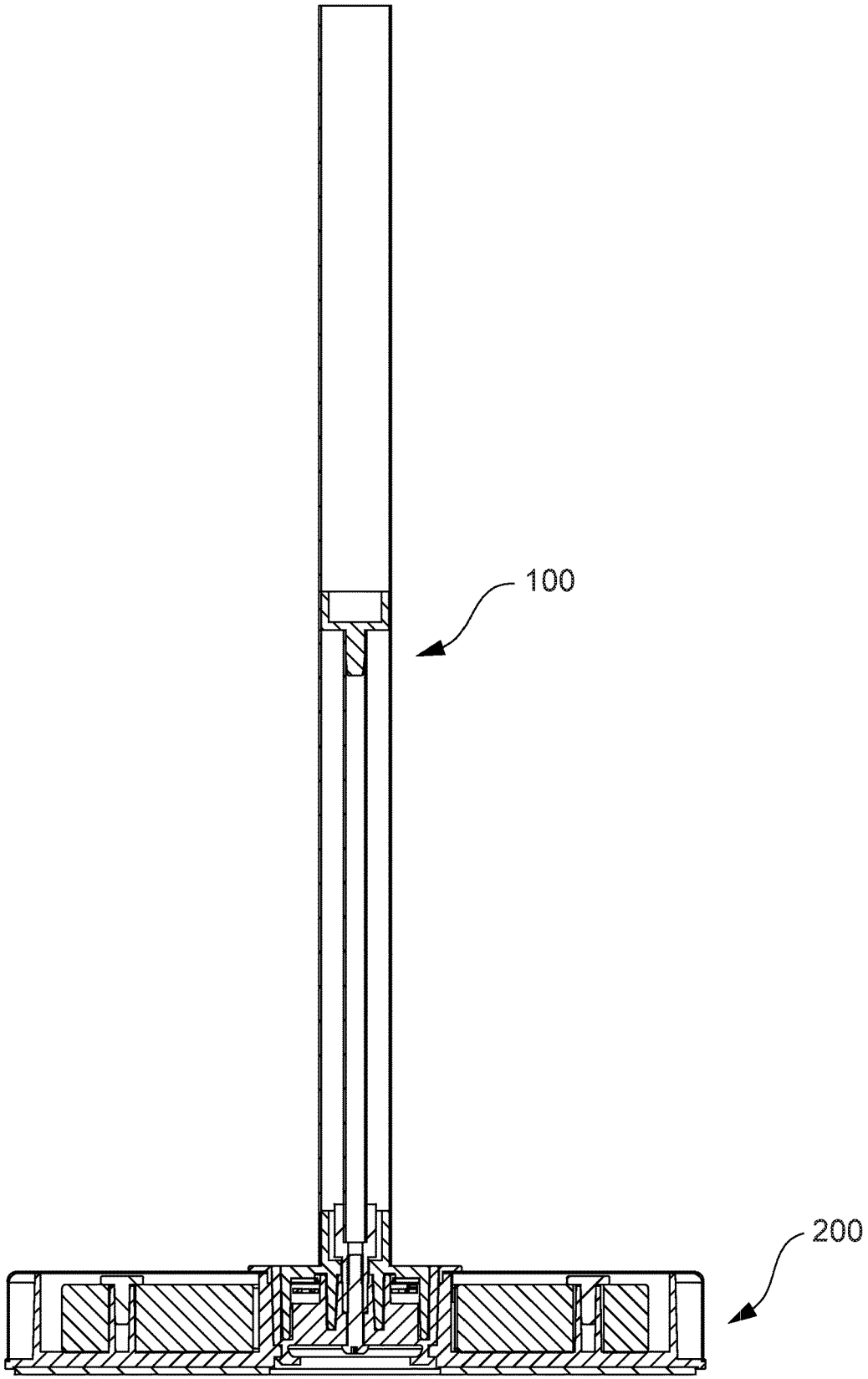
FIG. 2 shows a sectional view of the first embodiment.

FIGS. 1 and 2 show a first embodiment of the present invention. It comprises a rod member 100 and a base member 200, which are connected with each other.

Figure 3:
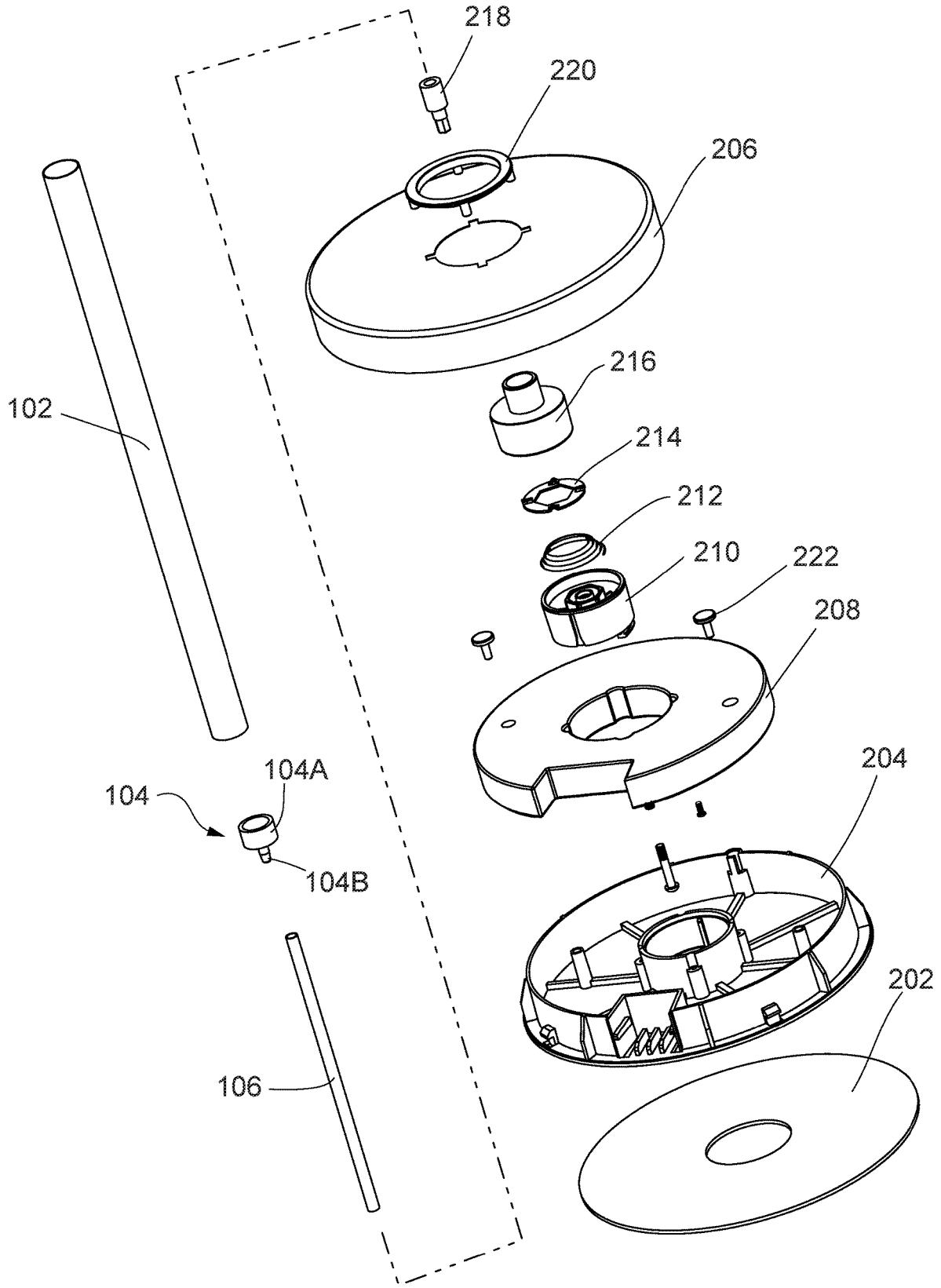
FIG. 3 is an exploded view of the first embodiment.

FIG. 3 is an exploded view of the first embodiment. It shows that the rod member 100 comprises a first rod 102, a connector 104, and a second rod 106. Referring to FIGS. 2-3, it shall be understood that the first rod 102 and the second rod 106 are elongate and hollow, and that the connector 104 is T-shaped and has an enlarged portion 104A and an elongate portion 104B. The size and shape of the enlarged portion 104A fits well to the internal cavity of the first rod 102, such that the connector 104 is configured to be snugly mounted/disposed in the internal cavity of the first rod 102. Preferably, the connector 104 is made of resilient material. The size and shape of the elongate portion 104B fits well to the internal cavity of the second rod 106, such that the elongate portion 104B is configured to be snugly mounted in the internal cavity of the second rod 106. The assembly of the first rod 102, the connector 104, and the second rod 106 provides an advantage that the assembly is less likely bendable when comparing with a single long rod having smaller moment of inertia. The rod member 100 provides a reinforcement effect when comparing with a single long rod. In this context, "hollow" means the rod can be configured to partially hollow along its longitudinal axis or thoroughly hollow along its longitudinal axis. It shall be understood that the rod member 100 is configured to fit most of the commercially available kitchen roll paper/kitchen roll towel, toilet roll paper/toilet roll towel. In particular, the diameter of the rod member 100 fits well to the central tube of these products.

Referring to FIG. 3, it shall be understood that the base member 200 comprises a sponge 202, a housing 204, a lid 206, a weight 208, a first receptacle 210, a resilient member 212, a disc 214, a rotation member 216, a stopper 218, and a cover 220.

Figure 4:
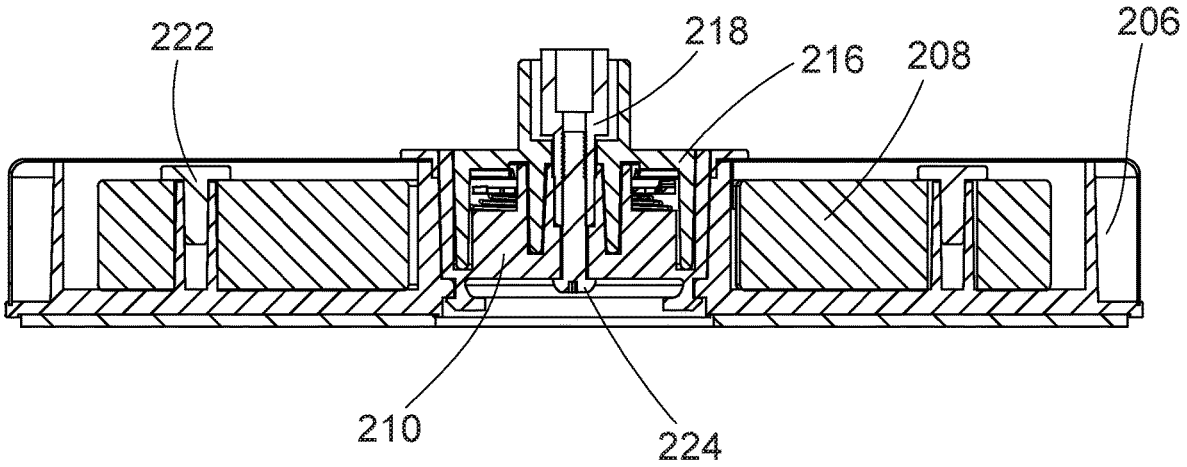
FIG. 4 shows a sectional view of a base member of the first embodiment.

FIG. 4 shows a sectional view of the base member 200 of the first embodiment, which clearly shows the connection between these components.

Figure 5A:
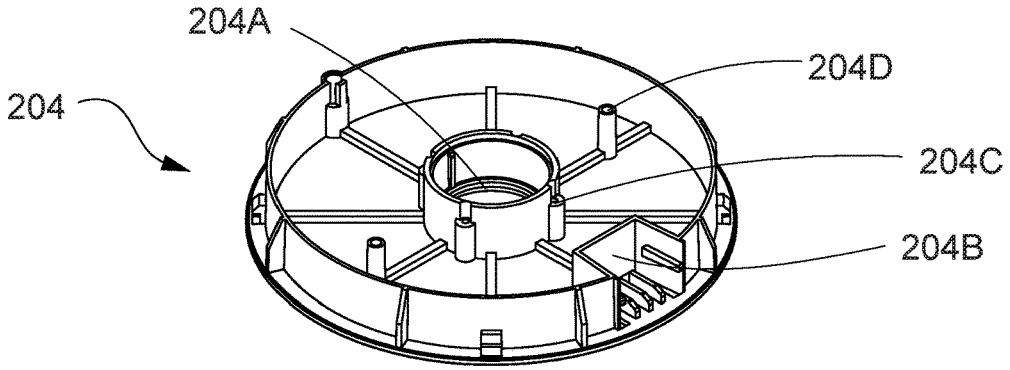
FIG. 5A-5C shows a housing of the first embodiment with different views.
Figure 5B:
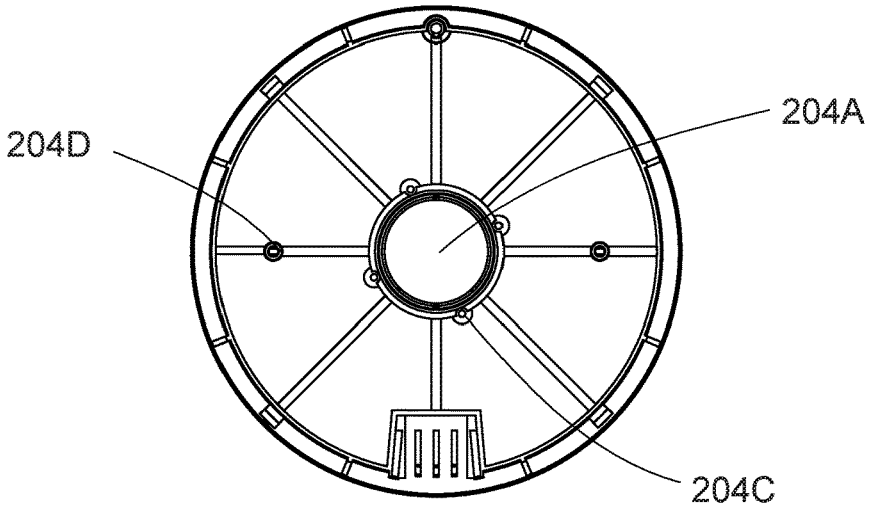
Figure 5C:
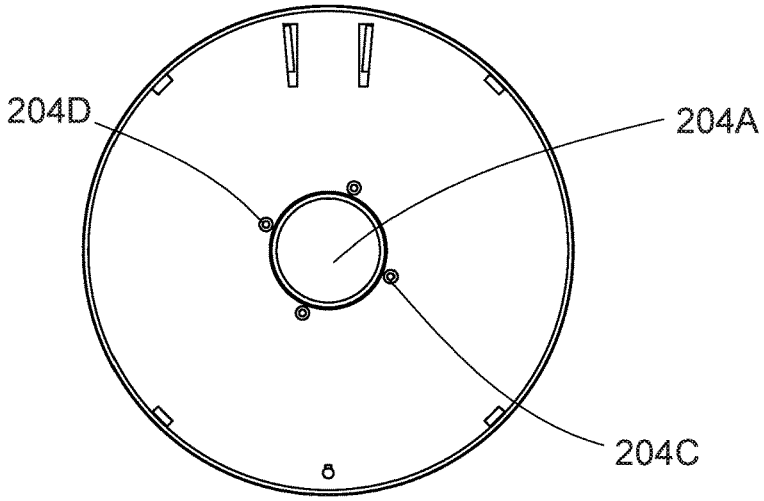

FIGS. 5A-5C show the housing 204 in different views, in which FIG. 5A is a perspective top view, FIG. 5B is an elevation view, and FIG. 5C is a bottom view. It shows that the housing 204 has a central bore 204A with a plurality of channels 204C, in cylindrical profile, around the central bore 204A; an aperture 204B at a portion of the perimeter of the housing 204; and two female fasteners 204D, in cylindrical profile, arranged on the diameter of the housing 204. It shall be understood that the configuration of the components is for illustration only, and shall not be construed as limitation to the present invention.

Figure 6:
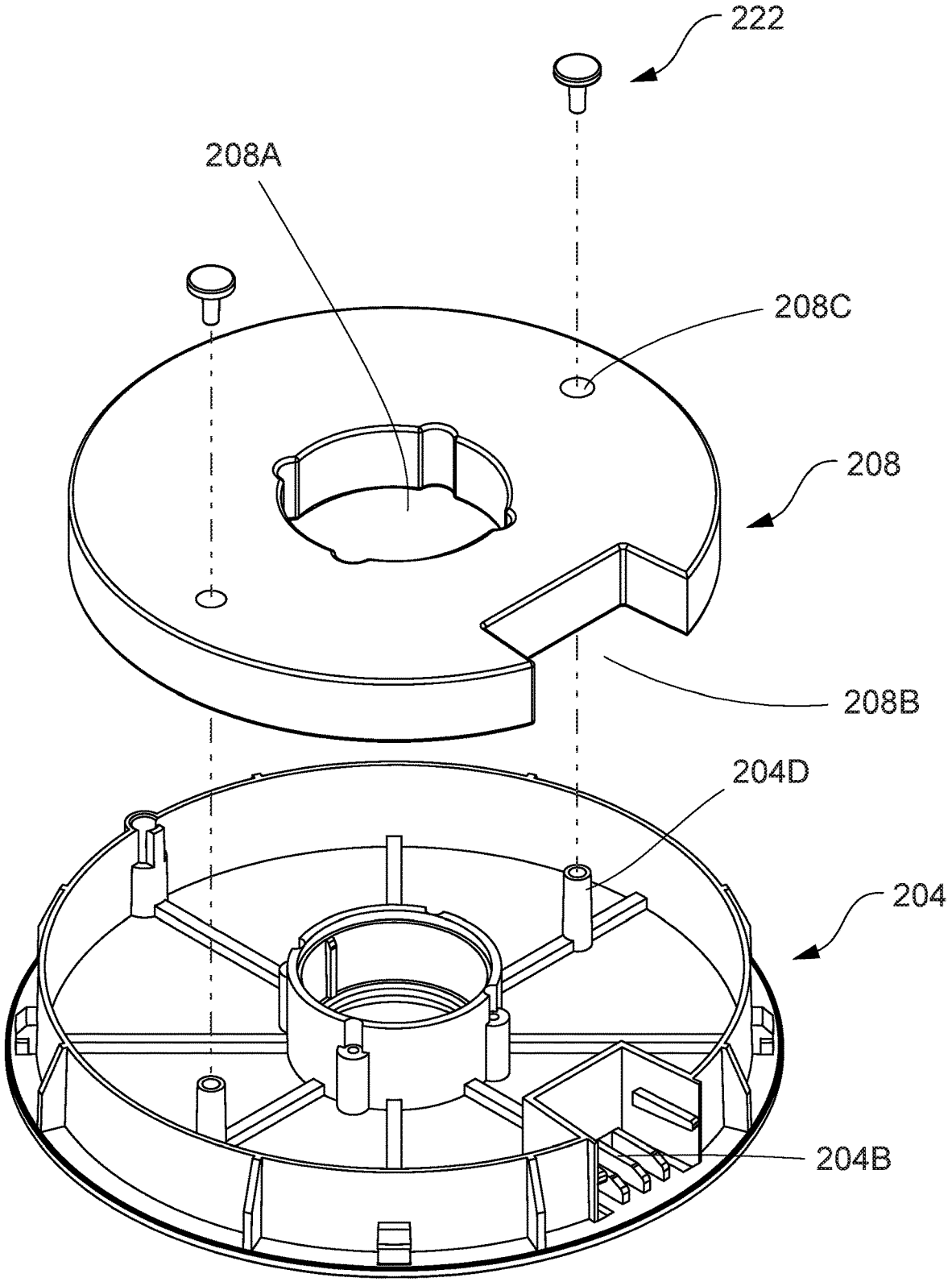
FIG. 6 shows the assembly between the housing, a weight, and a bolt.

FIG. 6 shows the assembly between the housing 204, the weight 208, and a male fastener 222, such as a bolt or a stud. It can be seen that the weight 208 is provided with a central bore 208A, an aperture 208B at a portion of the perimeter of the weight 208, and a pair of apertures 208C arranged on the diameter of the central bore 208A. The assembly in FIG. 6 is formed by first aligning the weight 208 over the housing 204, in which the aperture 208B aligns with the aperture 204B and the apertures 208C align with the female fasteners 204D. After alignment, the weight 208 is then received in the housing 204. Next, the male fastener 222 is then engaged with the female fastener 204D through the aperture 208C.

Figure 7A:
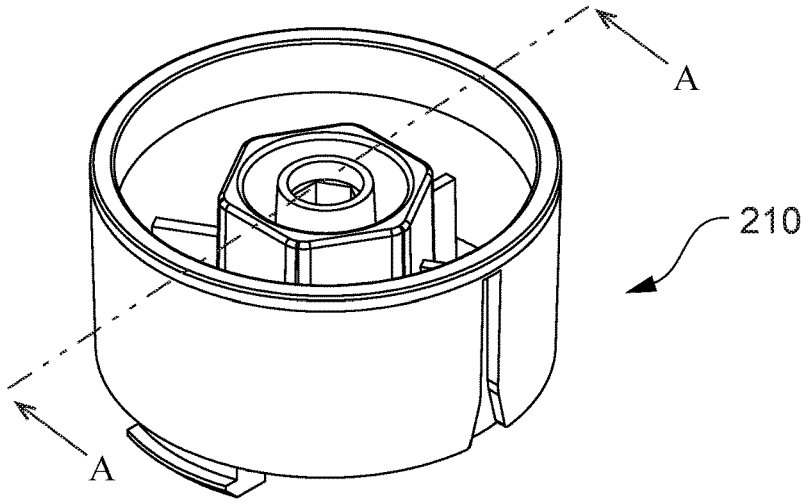
FIGS. 7A-C shows a first receptacle of the first embodiment with different views.
Figure 7B:
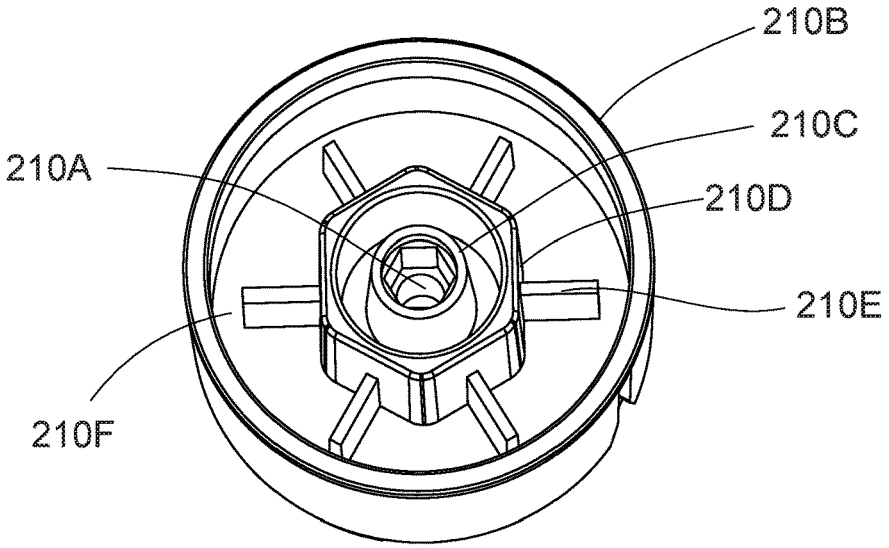
Figure 7C:
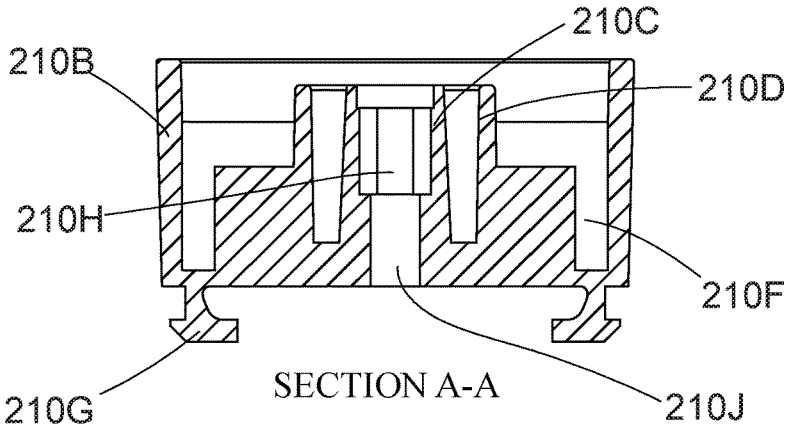

FIG. 7 shows the first receptacle 210 with different views, in which FIG. 7A is a perspective top view, FIG. 7B is a perspective elevation view, and FIG. 7C is a sectional view along the axis AA in FIG. 7A. The first receptable 210 is provided with a central bore 210A and a circumferential surrounding wall 210B. Circulating around the central bore 210A is a first standing wall 210C. Between the first standing wall 210C and the surrounding wall 210B is a second standing wall 210D. The position of the second standing wall 210D defines a first cavity between the first standing wall 210C and the second standing wall 210D, and a second cavity between the second standing wall 210D and the circumferential surrounding wall 210B. In the second cavity, a plurality of ridges extending therein in a direction from the second standing wall 210D to the circumferential surrounding wall 210B. Referring to FIG. 7B, the ridge 210E has a first end connecting with the second standing wall 210D and a second free end. There is a spacing 210F between the second free end and the surrounding wall 210B. At the bottom side of the first receptacle 210, there is provided with a pair of protruding fingers 210G. As illustrated in FIG. 7C, the second standing wall 210D is taller than the ridges 210E, which defines a step between the second standing wall 210D and the ridges 210E. FIG. 7C shows that the central bore 210A comprises an upper bore 210H and a lower bore 210J. Together with FIGS. 7B and 7C, it can be seen that the upper bore 210H is hexagonal shaped.

Figure 8A:
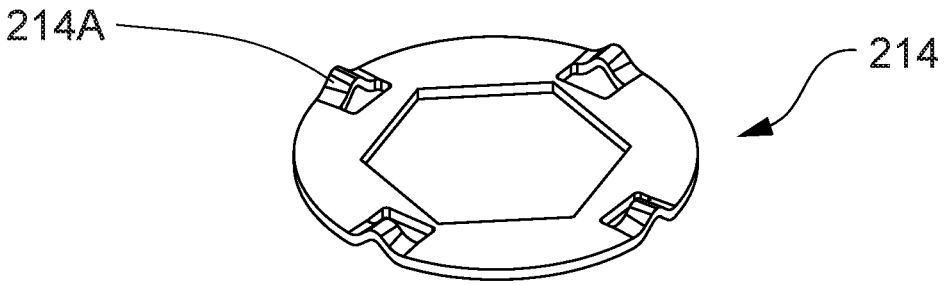
FIG. 8A-C show a disc of the first embodiment with different views.
Figure 8B:
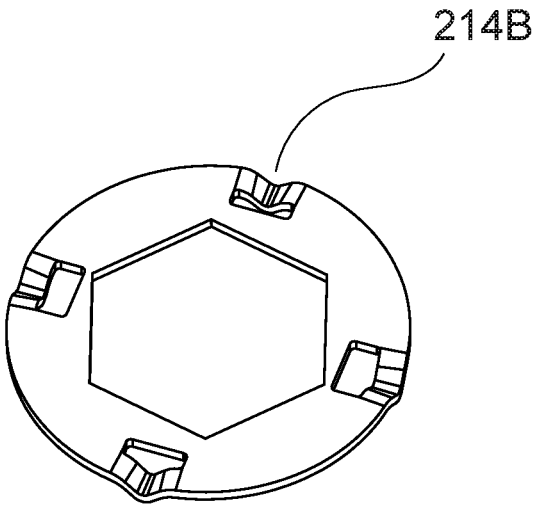
Figure 8C:
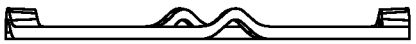

FIG. 8 shows the disc 214 with different views, in which FIG. 8A is a perspective top view, FIG. 8B is a perspective bottom view, and FIG. 8C is a side view. The disc 214 is a ring-shaped plate having a central cavity. On the top side of the disc 214, the perimeter edge of the disc 214 is provided with a plurality of crests 214A (or ramps). In other words, on the bottom side of the disc 214, the perimeter edge of the disc 214 is provided with a plurality of troughs 214B. The central cavity of the disc 214 is dimensioned to correspond to the size and shape of the second standing wall 210D of the first receptacle 210, such that the disc 214 can pass through the second standing wall 210D of the first receptacle 210 and sit on the ridges 210E of the first receptacle 210 when assembling the disc 214 to the first receptacle 210. It can be seen that the central cavity of the disc 214 is hexagonal, which corresponds to the shape defined by the second standing wall 210D. Due to this arrangement, it shall be understood that the disc 214 is difficult to move about the second standing wall 210D. The disc 214 is only able to move upwards and downwards, along the longitudinal direction of the rod member, with the assistance of the resilient member 212 which can be biased in the longitudinal direction of the rod member.

Figure 9A:
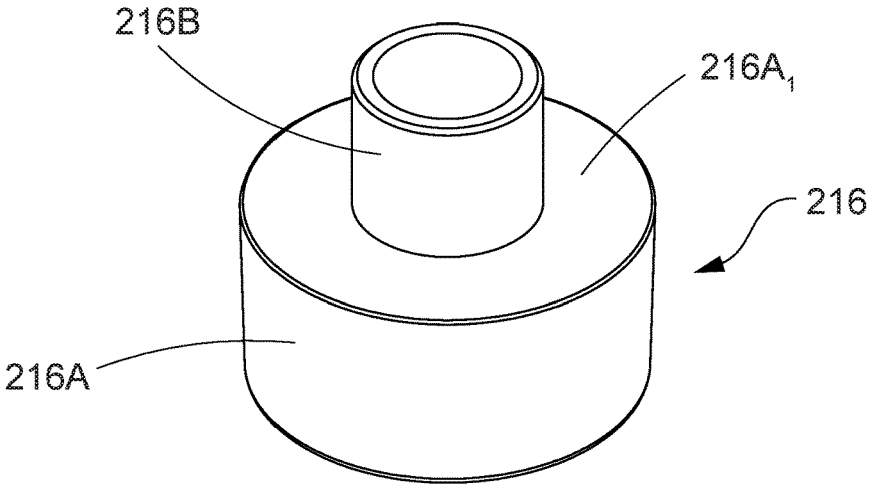
FIG. 9A-C show a rotation member of the first embodiment with different views.
Figure 9B:
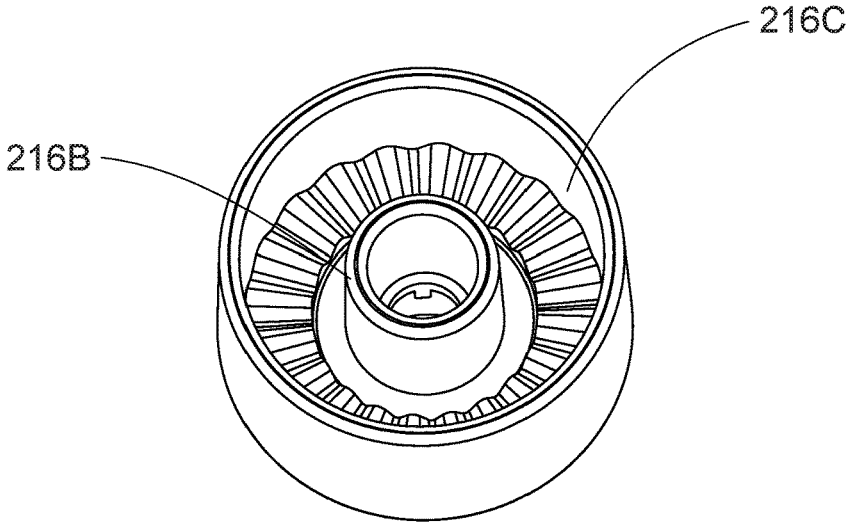
Figure 9C:
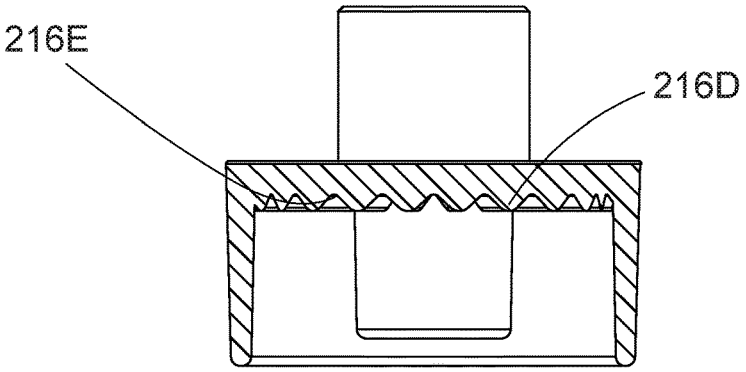

FIG. 9 shows the rotation member 216 with different views, in which FIG. 9A is a perspective top view, FIG. 9B is a perspective bottom view, and FIG. 9C is a sectional view in its longitudinal plane. The rotation member 216 has a first portion 216A and a second portion 216B. The first portion 216A adapts in a form of hollow cup having an open-bottom, a top-plate 216$A_1$, and a circumferential wall 216C. The second portion 216B is a hollow bushing extending through the top-plate 216$A_1$ of the first portion 216A, such that the top-plate 216$A_1$ is provided with a central cavity. The second portion 216B has two parts, the first part is outwardly exposed on the top-plate 216$A_1$ of the first portion 216A and the second part is disposed in the internal cavity of the first portion from the underside of the top-plate 216$A_1$ of the first portion 216A. As shown in FIG. 9B, the second part of the second portion 216B can be seen in the internal cavity of the first portion 216A, i.e., the underside of the top-plate 216$A_1$ of the first portion 216A. FIGS. 9B-9C shows that the underside of the top plate of the first portion 216A is provided with a plurality of crests 261D and trough 216E alternately arranged. Preferably, the crests and troughs are radially formed continuously around the second part of the second portion 216B. More preferably, the crests and troughs are formed in a form of serpentine.

Figure 10:
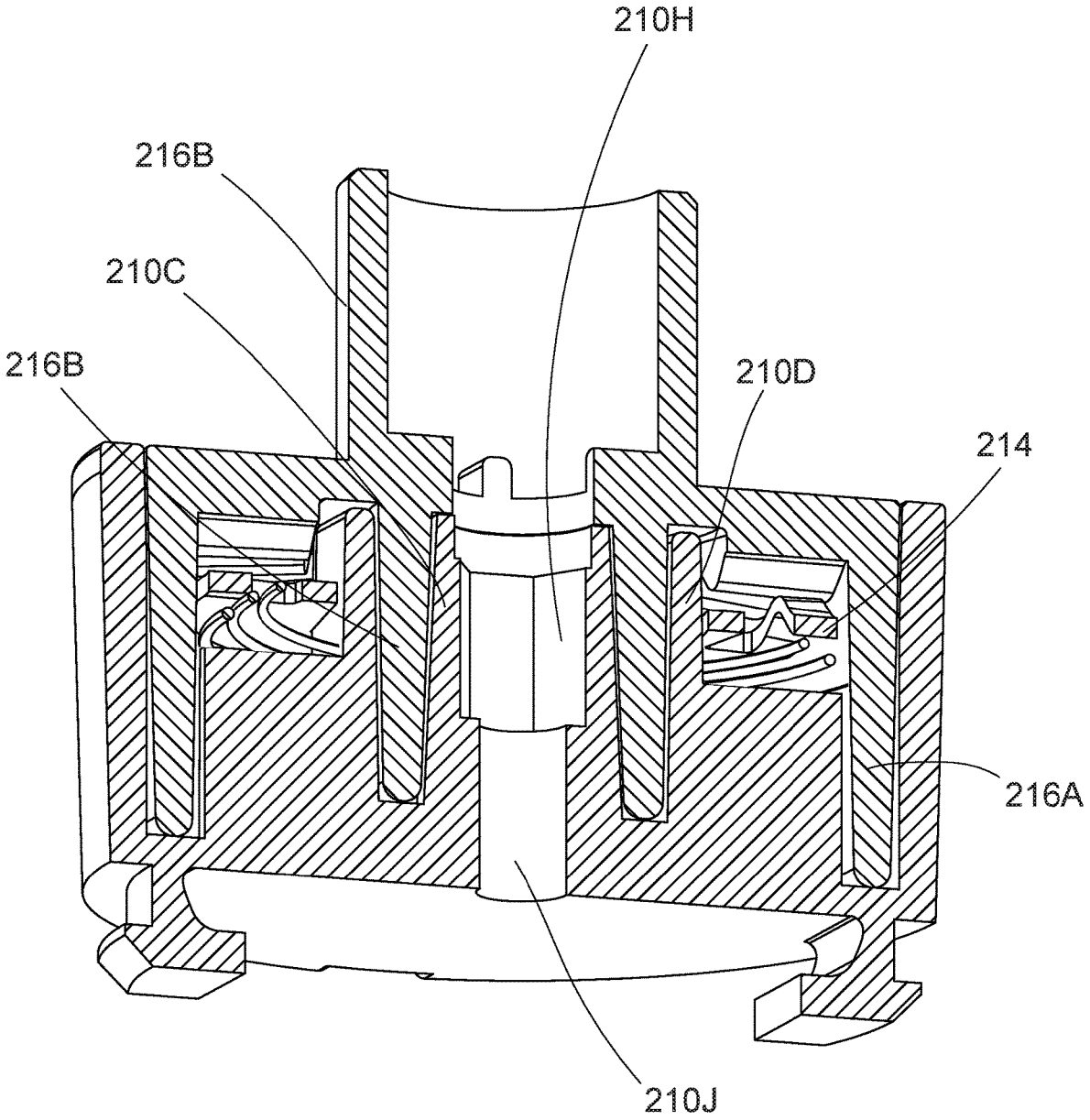
FIG. 10 shows the assembling between the rotation member, the disc, the first receptacle, and a resilient member.

FIG. 10 shows the assembly between the rotation member 216, the disc 214, the first receptacle 210, and the resilient member 212. It shows that the second part of the second portion 216B is received in the cavity between the first standing wall 210C and the second standing wall 210D of the first receptacle 210, and that the circumferential wall 216C of the first portion 216A is received in the spacing 210F of the first receptacle 210. Due to this arrangement, the rotation member 216 rotates with respect to the first receptacle 210. It shows that the resilient member 212 sits on the ridges 210E of the first receptacle 210 and is between the ridges 210E and the disc 214.

Figure 11B:
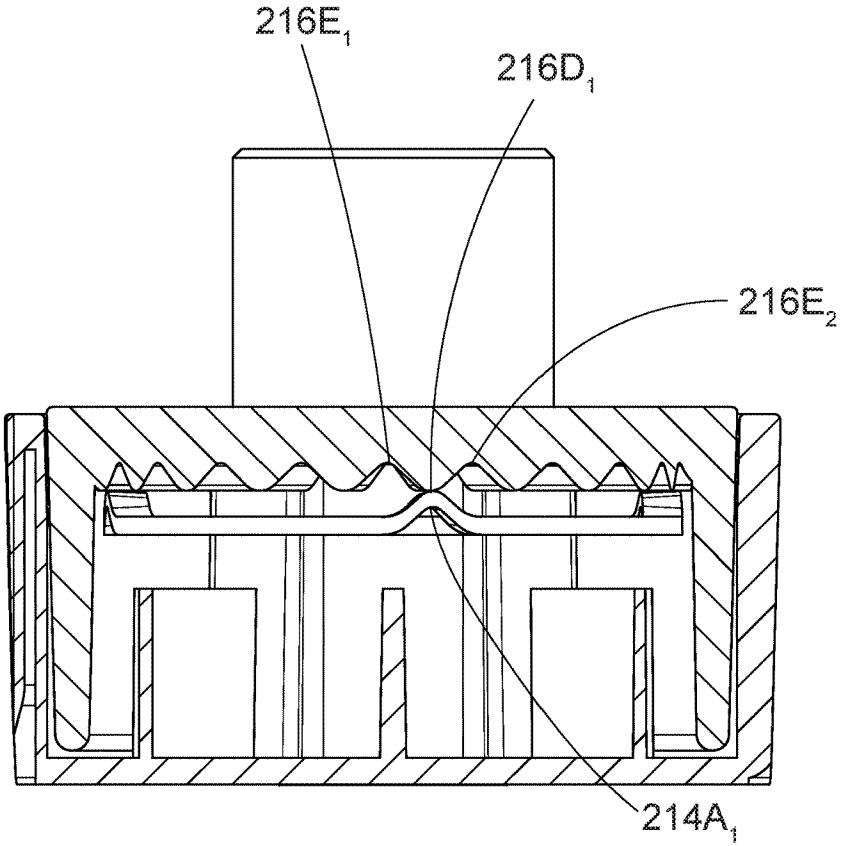
FIGS. 11A-B show the engagement between the rotation member and the disc.
Figure 11A:
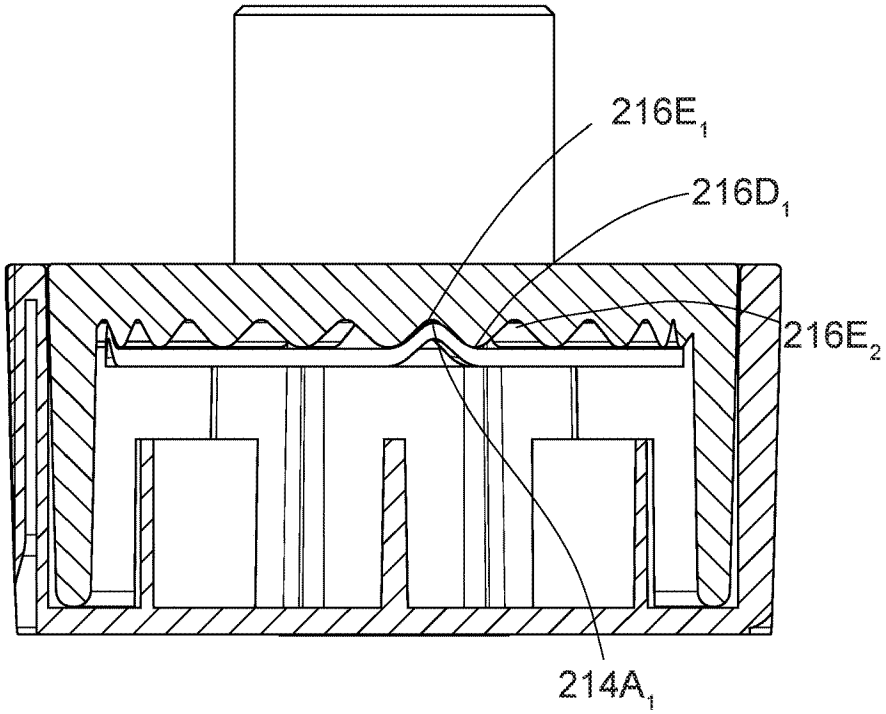

FIGS. 11A-B show the engagement and operation between the rotation member 216 and the disc 214. For the sake of brevity, the rotation member 216 is shown in sectional view showing the crest 216$D_1$ and troughs 216$E_1$, 216$E_2$. FIG. 11A shows that the crest 214$A_1$ of the disc 214 engages with the trough 216$E_1$ of the rotation member 216. FIG. 11B shows that the crest 214$A_1$ of the disc 214 engages with the crest 216$D_1$ of the rotation member 216.

Figure 12A:
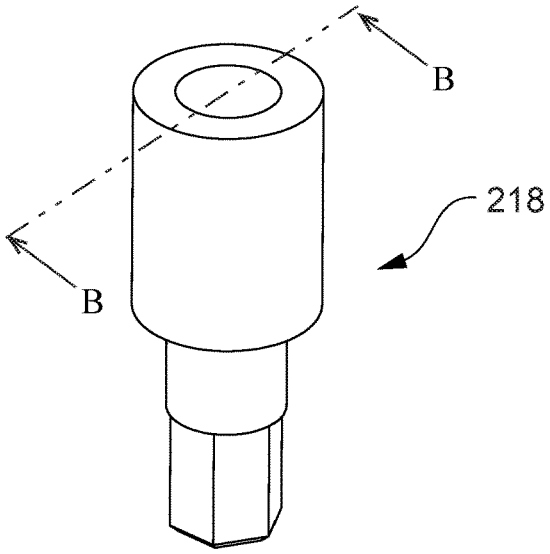
FIGS. 12A-C shows a stopper of the first embodiment with different views.
Figure 12B:
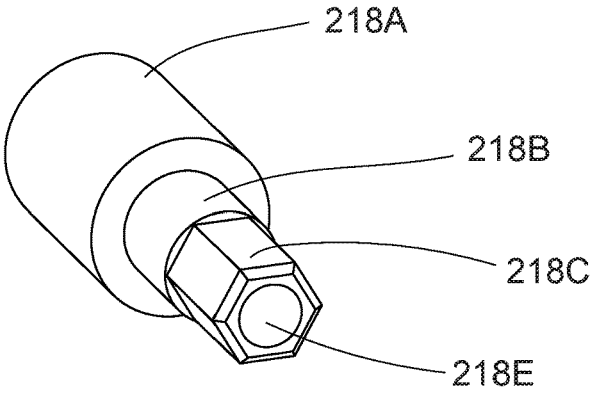
Figure 12C:
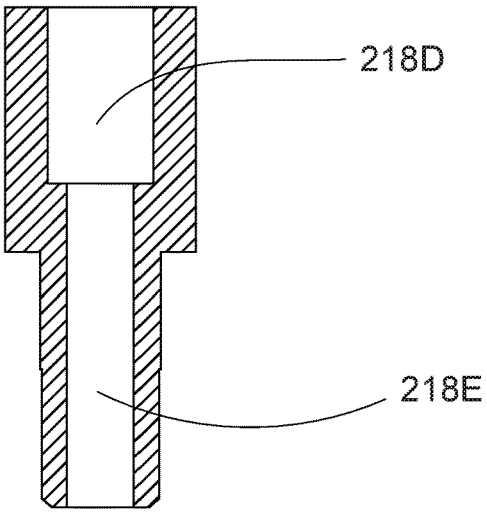

FIGS. 12A-12C shows the stopper 218, in which FIG. 12A is the perspective elevation view, FIG. 12B is a perspective bottom view, and FIG. 12C is a sectional view along the axis BB in FIG. 12A. The stopper 218 is in cylindrical profile and is provided with an upper portion 218A, a middle portion 218B, and a lower portion 218C. The perimeter of the upper portion 218A and the middle portion 218B are circular, and the dimension of the cross section in traverse plane of the upper portion 218A is larger than that of the middle portion 218B. The perimeter of the lower portion 218C is for example hexagonal shaped. In one embodiment, the dimension of the cross section in traverse plane of the lower portion 218C is the least among the upper portion, the middle portion, and the lower portion. It is advantageous to configure the shape of the perimeter of the lower portion 218C to be substantially the same as the shape of the upper bore 210H of the first receptacle 210. It is further advantageous to configure the shape of the upper bore 218D to be substantially the same as the shape of the perimeter of the second rod 106.

Figure 13:
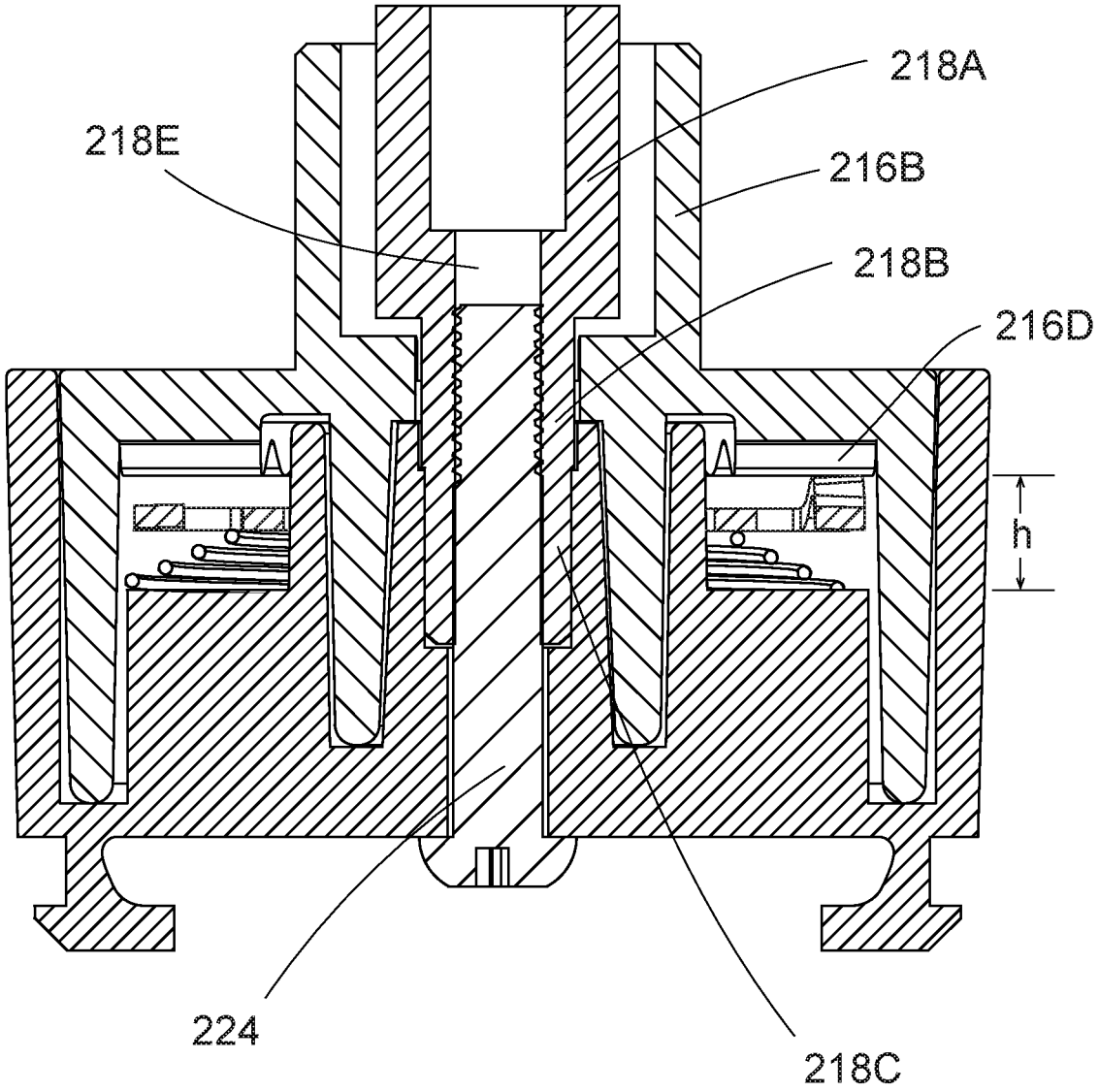
FIG. 13 shows the assembly between the assembly in FIG. 10 with the stopper and a fastener.

FIG. 13 shows the assembly between the assembly in FIG. 10 with the stopper 218 and a fastener 224, in which the lower portion 218C of the stopper 218 is received in the upper bore 210H of the first receptacle 210 through the central cavity of the top-plate 216$A_1$ of the first portion 216A, and the fastener 224 is fasten to the lower bore 218E of the stopper 218, thereby the stopper 218 is secured to the first receptacle 210. It shall be noted that the upper portion 218A of the stopper 218 does not engage with the cavity of the first part of the second portion 216B of the rotation member 216, therefore the rotation of the rotation member 216 about the stopper is not limited.

Referring to FIGS. 10, 11, and 13, the resilient member 212 is disposed between the ridges 210E of the first receptacle 210 and the disc 214. Assuming that the assembly in FIGS. 11A and 11B shows the rotation member 216 and the disc 214 in FIG. 13, then it shall be understood that the resilient member 212 is considered as relaxed in FIG. 11A when comparing with that in FIG. 11B. On the contrary, the resilient member 212 is considered as compressed in FIG. 11B when comparing with that in FIG. 11A. In FIG. 11A, the crest 214$A_1$ of the disc 214 acts upon the trough 216$E_1$ of the rotation member 216, thereby the resilient member 212 is relatively relaxed. When the rotation member 216 rotates further, for example from FIG. 11A to 11B by anti-clockwise rotation, the crest 214$A_1$ of the disc 214 acts upon the crest 216$D_1$ of the rotation member 216, thereby the resilient member 212 is relatively compressed.

With arrangement described above, in particular the arrangements in FIGS. 11A and 11B, it shall be understood that when a roll of kitchen roll paper is mounted to the paper towel holder of the present invention by passing the tube of the kitchen roll paper through the rod member 100, the state of the rotation member 216 and the disc 214 shall be in the state as shown in FIG. 11A, i.e., the crest 214$A_1$ of the disc 214 is received in the trough 216$E_1$ of the rotation member 216, and the resilient member 212 is relaxed in the longitudinal direction of the rod member.

Referring to the figures, it shall be understood that when the tube of the kitchen roll paper is passed through the rod member 100, the internal surface of the tube engages closely with the outer surface of the rod member 100. When a user starts to roll the kitchen roll paper that is mounted to the rod member 100, the rolling action performed by the user leads the rotation member 216 rotates about the rod member 100 which is snugly fitted to the rotation member 216 as described above. Therefore, when a user starts to roll the kitchen roll paper that is mounted to the rod member 100, the kitchen paper roll, the rod member 100, and the rotation member 216 unitary rotate about the stopper 218, and there is rotation of the rotation member 216 with respect to the disc 214, for example the rotation member 216 rotates anti-clockwise, a state changing from FIG. 11A to 11B. During such anti-clockwise rotation, it shall be understood that the crest 216$D_1$ of the rotation member 216 slides upwards to meet the crest 214$A_1$ of the disc 214, thereby compressing the resilient member 212. When the rotation member 216 in FIG. 11B continues to rotate further in anti-clockwise, the crest 216$DI_1$ of the rotation member 216 slides downwards, and then the trough 216$E_2$ meets the crest 214$A_1$ of the disc 214, thereby relaxing the resilient member 212. In this example, the rolling action performed by a user triggers the rotation member 216 starts to slide over the disc 214 from the trough 216$E_1$ to the trough 216$E_2$. When the crest 214$A_1$ of the disc 214 is received by the trough 216$E_2$ of the rotation member 216, thereby providing a resistance against the rolling action. It shall be understood that the resistance described above is related to the compression intensity of the resilient member 212, and the time for the resilient member 212 to bounce off. During the rolling action, a sheet of kitchen paper is unwinding from the roll. However due to the resistance described above, the rotation of the kitchen roll paper is limited and thus a sheet of kitchen paper is unrolled with a length that is approximate to a predefined length to be torn determined by the dotted tear line between each sheet of kitchen paper. It allows the user to tear the unwound kitchen paper easily along the dotted tear line.

It shall be understood that the paper towel holder of the present invention is applicable to fit most of the commercially available rolled products such as kitchen roll paper/kitchen roll towel, toilet roll paper/toilet roll towel. In these products, the width of each sheet of material to be torn is different. If resistance provided to the rolling action is faster or stronger than required, the sheet of material to be torn may be broken off before it should have been torn along the dotted tear line. To cater the need to provide said resistance with different intensity and with different response time, the present invention provides convenience to user to adjust the fastening strength of the fastener 224 to the stopper 218.

The use of the fastener 224, in the assembly described above, provides a technical advantage in that the fastener 224 can control the distance between the underside of the top-plate 216$A_1$ of the rotation member 216 and the top edge of the ridge 210E. Specifically, the distance between the crest 261D (or the trough 216E) of the rotation member 216 and the top edge of the ridge 210E. Referring to FIG. 13, it shall be understood that when the fastener 224 is more rigidly fastened to the stopper 218 (the longer region of the fastener 224 inserted into/threaded to the lower bore 218E), the distance h becomes shorter, such that the springy effect provided by the resilient member 212 is smaller. On the contrary, when the fastener 224 is less rigidly fastened to the stopper 218 (the shorter region of the fastener 224 inserted into/threaded to the lower bore 218E), the distance h becomes longer, such that the springy effect provided by the resilient member 212 is stronger. With a stronger springy effect, it shall be understood that compression intensity of the resilient member 212 is stronger and the time for the resilient member 212 to bounce off is shorter, thereby the resistance provided to the rolling action is stronger and faster. It shall further be understood that the fastener 224 can adjust the compression intensity of the resilient member 212 and the bounce-off time of the resilient member 212.

Figure 14A:
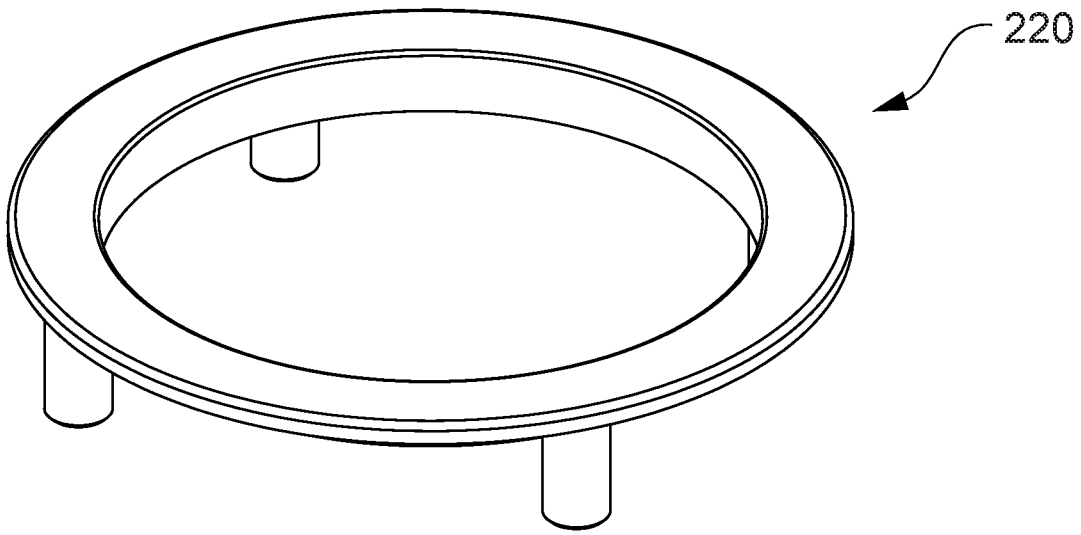
FIG. 14A-B shows a cover of the first embodiment with different views.
Figure 14B:
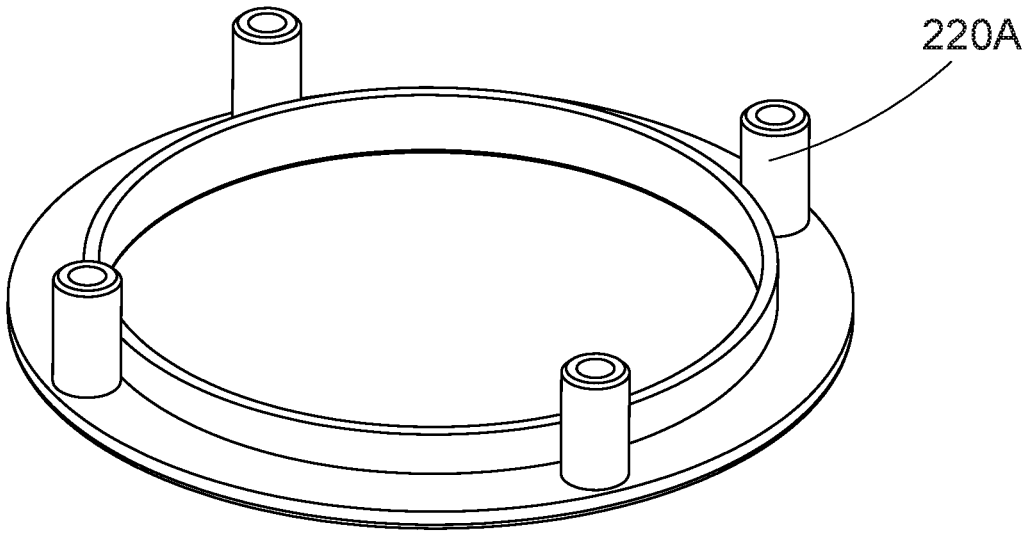

FIG. 14A-14B shows the cover 220 which is configured to be a ring-shaped plate having a central cavity. As seen, a plurality of legs 220A outwardly extends from the underside of the ring-shaped plate. The legs 220A are dimensioned receivable by the channels 204C.

Figure 15:
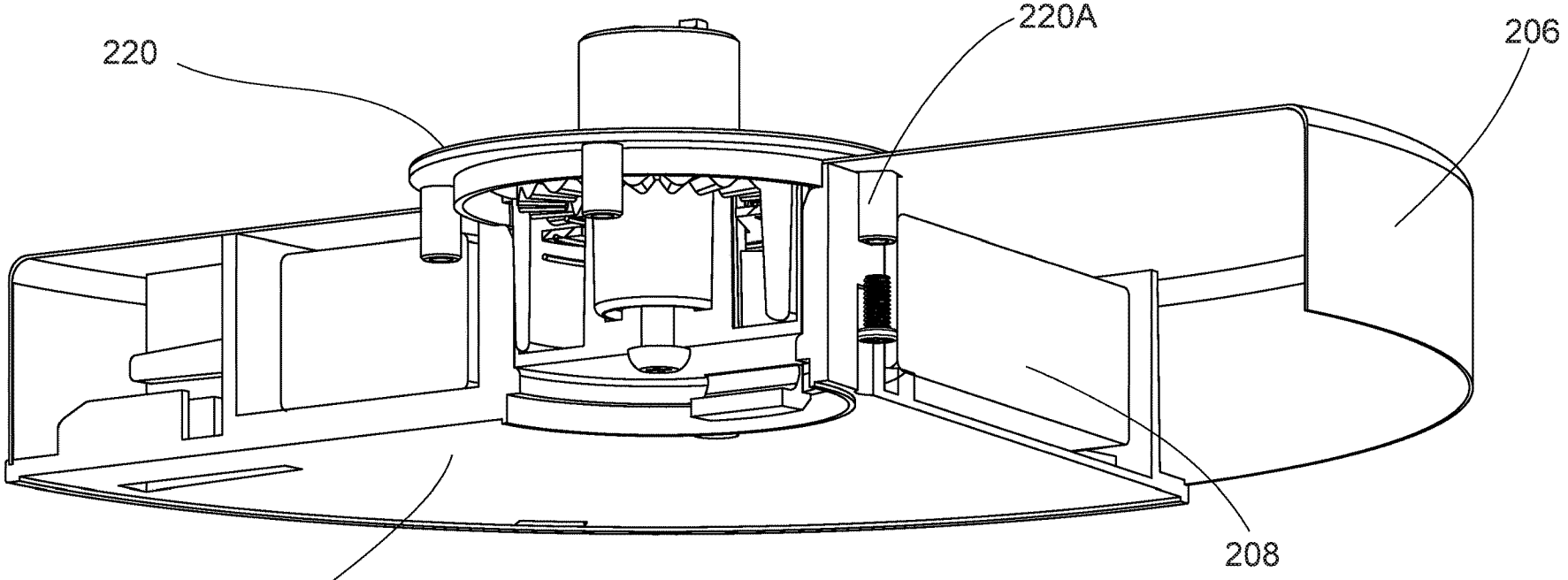
FIG. 15 shows a lid of the first embodiment is secured to the housing of the first embodiment.

As seen in FIGS. 3, 4 and 15, the lid 206 is provided with a central aperture through which part of the stopper 218 and the rotation member 216 are outwardly exposed. Referring to FIG. 15, the cover 220 is assembled to the lid 206 by sitting the ring-shaped plate of the cover 220 over the perimeter of the central aperture of the lid 206. A screw is screwed to the leg 220A of the cover 220 in the channel 204C of the housing 204, thereby the lid 206 is fasten to the housing 204. According to the present invention, which provides a compartment for accommodating the weight 208, the first receptacle 210, the resilient member 212, the disc 214, the rotation member 216, and the stopper 218. In one embodiment, the compartment comprises the lid 206, the housing 204, and may further the cover 220.

Figure 16:
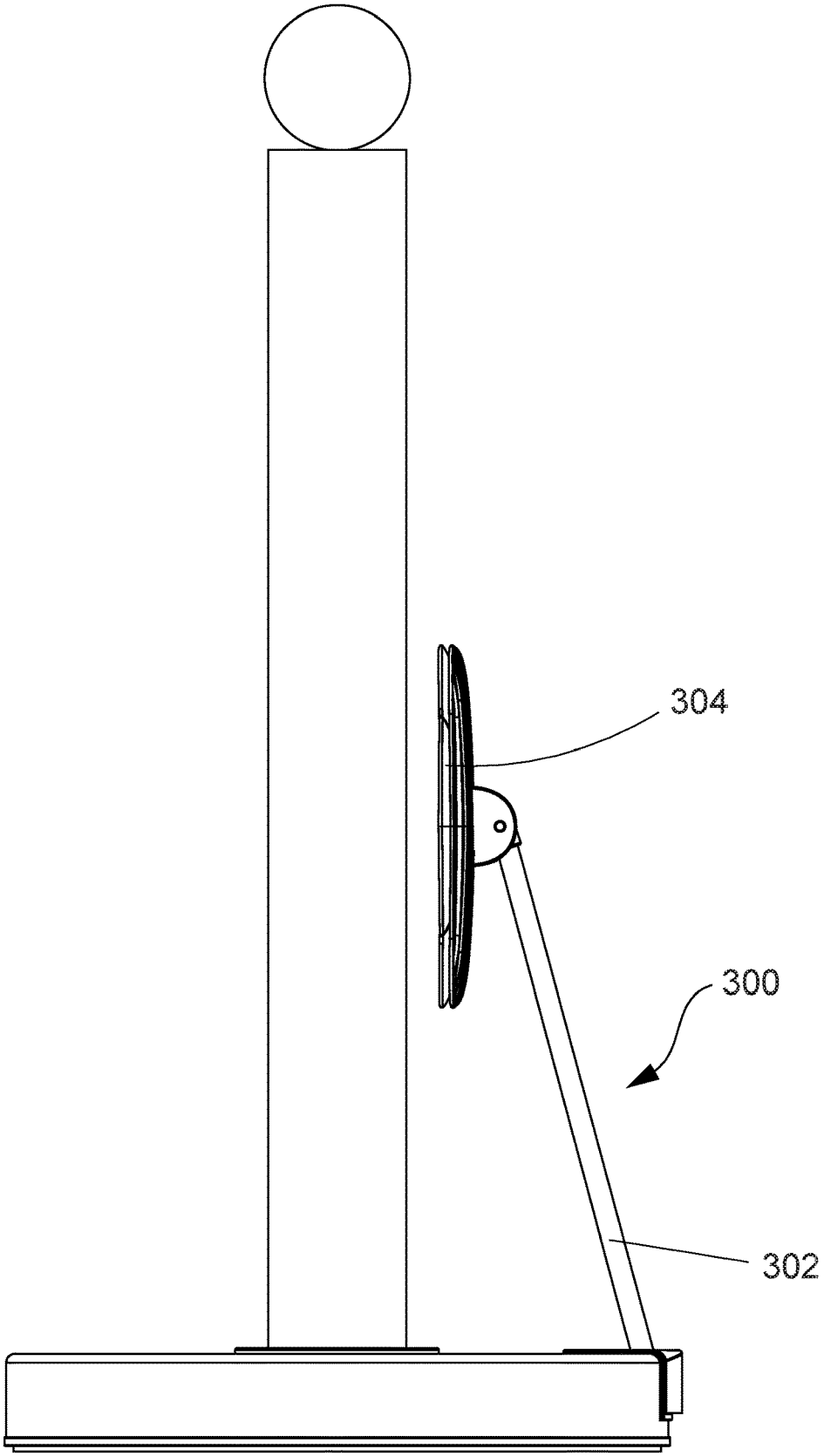
FIG. 16 shows a second embodiment of the present invention.
Figure 17:
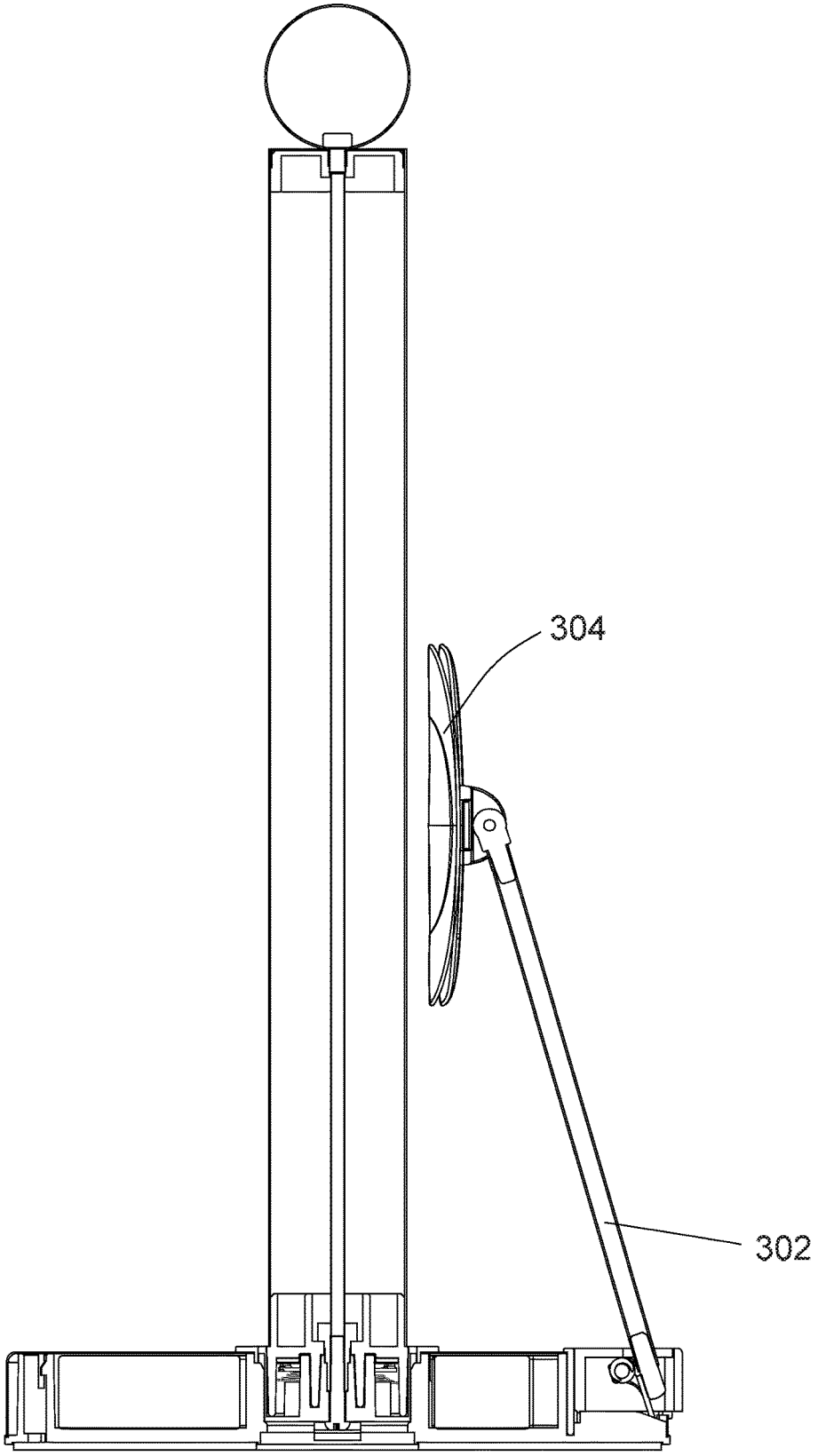
FIG. 17 is a sectional view of the second embodiment in FIG. 16.

FIGS. 16-17 show a second embodiment of the present invention. As shown, it provides with an auxiliary arm member 300 having a stick 302 and a pad 304. The auxiliary arm member 300 is assembled to the aperture 204B (c.f. FIG. 5A). The auxiliary arm member 300 is configured to slant towards the rod member 100, such that the pad 304 is configured to act on for example a roll of kitchen roll paper to keep the paper from blowing away in a breeze. In addition, the auxiliary arm member 300 provides assistance to the tearing action of the sheet of kitchen paper from a roll, avoiding another sheet of kitchen paper unrolling during the tearing action.

Figure 18:
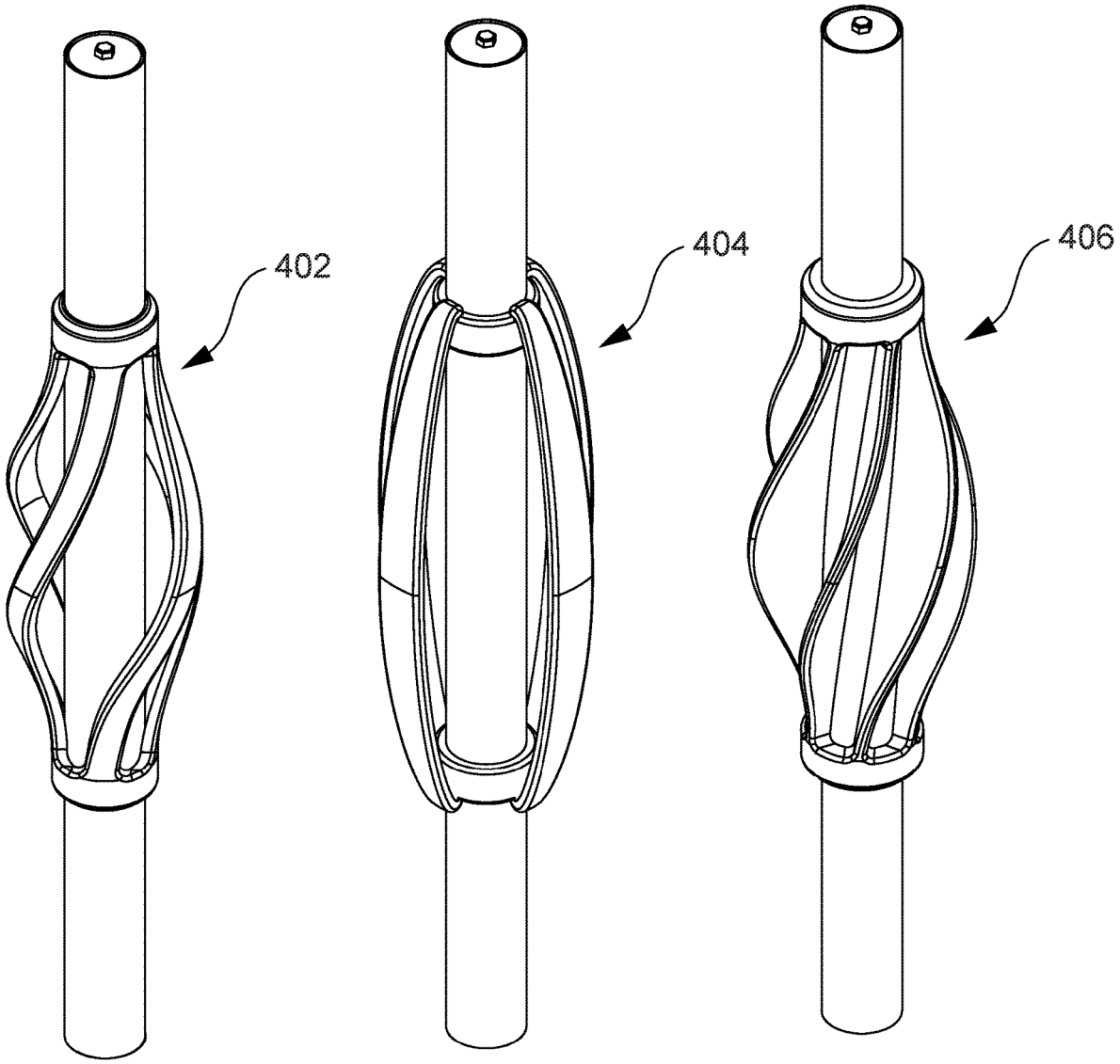
FIG. 18 shows variants of enhancer sleeved to the rod member.

FIG. 18 shows three embodiments of an enhancer of the present invention assembled to the rod member, in which FIG. 18A shows enhancer 402, FIG. 18B shows enhancer 404, and FIG. 18C shows enhancer 406. The enhancers are designed to provide a plurality of edges or ridges bulging outwards from the rod member, preferably helical around the rod member. The use of enhancer helps enhancing the engagement between the rod member and the central tube of the roll paper, providing ease to user to roll the roll paper and tear off a whole sheet with one hand.

It shall be understood that certain features of the invention, which are, for clarity. described in the content of separate embodiments, may be provided in combination in a single embodiment. Conversely, various features of the invention which are, for brevity, described in the content of a single embodiment, may be provided separately or in any appropriate sub-combinations. Also, a skilled person in the art would be aware of the prior art which is not explained in the above for brevity purpose. It is to be noted that certain features of the embodiments are illustrated by way of non-limiting examples. For example, the size and shape and position of the disclosed components can be adaptively changed to cater different users' need. The disclosed components are all examples to illustrate the present invention only and shall not construe as limiting to the scope of protection. Those skilled in the art could adjust and/or modify these components according to actual needs, and variations therefrom also fall into the scope of the present invention.

What is claimed is:

1. A holder, for kitchen roll paper, kitchen roll towel, toilet roll paper, or toilet roll towel, comprising:

a base member, comprising:

a compartment;

a first receptacle, comprising:

a circumferential wall;

a central bore having an upper bore and a lower bore;

a first standing wall surrounding said central bore;

a second standing wall disposed between said first standing wall and said circumferential wall, wherein the position of said second standing wall defines a first cavity between said first standing wall and said second standing wall, and defines a second cavity between said second standing wall and said circumferential wall; and a plurality of ridges extending away from said second standing wall, wherein each said ridges comprising a first end connecting said second standing wall and a second free end, the position of said second free end defines a spacing between said second free end and said circumferential wall;

one elastic spring, disposed on said ridges of said first receptacle and circulates around said second standing wall of said first receptacle, thereby said elastic spring can be compressed or relaxed in the longitudinal direction of said holder;

a disc, comprising a ring-shaped plate and a plurality of ramps protruding therefrom, said disc is disposed on said elastic spring by passing the central cavity of said disc through said second standing wall of said first receptacle, wherein said plurality of ramps facing opposite said elastic spring;

a rotation member, comprising:

a hollow cup, having a top-plate defining an underside and connecting to a circumferential wall defining an open-bottom;

a hollow bushing extending through said top-plate of said hollow cup, such that an upper part of said hollow bushing is outwardly exposed from said top-plate of said hollow cup and a lower part of said hollow bushing is surrounded by said circumferential wall of said hollow cup;

wherein the underside of said top-plate of said hollow cup is provided with a plurality of crests and trough alternately arranged and radially formed continuously around said lower part of said hollow bushing; and said rotation member is assembled to said first receptacle, wherein the lower part of said hollow bushing is received in said first cavity of said first receptacle, and that said circumferential wall of said hollow cup is received in said spacing of said first receptacle, thereby said rotation member rotatable with respect to said first receptacle;

a stopper, comprising a first portion received in said upper part of said hollow bushing and a second portion partially received in said upper bore of said first receptacle; and a fastener, installed in said lower part of said hollow bushing, for fastening the assembly formed by said first receptacle, said rotation member, and said stopper; and a rod member, comprising a first rod, a second rod, and a connector connecting said first rod and said second rod, wherein said rod member engaging the upper part of said hollow bushing.

2. A holder, for rolled paper products, comprising:

a base member, comprising:

a compartment;

a first receptacle, fixed to said compartment, comprising:

a first standing wall defining a central bore; and a plateau;

a resilient member that can be biased along the longitudinal direction of said holder, disposed on said plateau of said first receptacle and being coaxial with said central bore of said first receptable;

a disc disposed on said resilient member and comprising a ring-shaped plate and at least one ramp protruding therefrom facing away said resilient member, said disc being coaxial with said central bore of said first receptable;

a rotation member, comprising a plate with a central aperture and having a complementary structure to the structure of said first receptacle such that said rotation member fittingly assemble to said first receptacle; in the assembly between said first receptacle and said rotation member:

said rotation member can be rotated with respect to said first receptacle;

said central aperture of said rotation member superimposed to said central bore of said first receptacle; and said plate of said rotation member separating from said plateau of said first receptacle defines an adjustable cavity for accommodating said resilient member and said disc, wherein said plate of said rotation member is provided with a plurality of crests and troughs facing said ramp of said disc;

a stopper, partially received in said central bore of said first receptacle and said aperture of said rotation member; and a fastener, for fastening said stopper to said first receptacle, wherein said stopper is profiled to maintain the assembled state of said rotation member to said first receptacle, and can be used to adjust said adjustable cavity defined by said plate of said rotation member and said plateau of said first receptacle; and a rod member, contacting said rotation member.

3. The holder as claimed in claim 2, wherein said first receptacle further comprising a circumferential wall, said plateau disposed between said first standing wall and said circumferential wall, wherein the position of said plateau defines a first cavity between said first standing wall and said plateau, and defines a second cavity between said plateau and said circumferential wall.

4. The holder as claimed in claim 3, wherein said plateau is formed by a second standing wall connecting a plurality of ridges, wherein:

said second standing wall disposed between said first standing wall and said circumferential wall;

the position of said second standing wall defines said first cavity between said first standing wall and said second standing wall, and defines said second cavity between said second standing wall and said circumferential wall; and said ridges extending away from said second standing wall.

5. The holder as claimed in claim 4, wherein each said ridges comprising a first end connecting said second standing wall and a second free end, the position of said second free end defines a spacing between said second free end and said circumferential wall.

6. The holder as claimed in claim 4, wherein said resilient member is one spring disposed on said ridges of said first receptacle and configured to circulate around said second standing wall of said first receptacle.

7. The holder as claimed in claim 4, wherein said disc being coaxial with said central bore of said first receptable by passing the central cavity of said disc through said second standing wall of said first receptacle.

8. The holder as claimed in claim 4, wherein said rotation member comprising a hollow cup, defined by said plate connecting a circumferential wall defining an open bottom; and a hollow bushing extending through said plate of said hollow cup, such that an upper part of said hollow bushing is outwardly exposed from said plate of said hollow cup and a lower part of said hollow bushing is surrounded by said circumferential wall of said hollow cup.

9. The holder as claimed in claim 8, wherein said rotation member is assembled to said first receptacle, wherein said lower part of said hollow bushing is received in said first cavity of said first receptacle, and that said circumferential wall of said hollow cup is received in said second cavity of said first receptacle.

10. The holder as claimed in claim 8, wherein each said ridges comprising a first end connecting said second standing wall and a second free end, the position of said second free end defines a spacing between said second free end and said circumferential wall;

said rotation member is assembled to said first receptacle, wherein the lower part of said hollow bushing is received in said first cavity of said first receptacle, and that said circumferential wall of said hollow cup is received in said spacing of said first receptacle.

11. The holder as claimed in claim 8, wherein said stopper comprising a first portion received in said upper part of said hollow bushing of said rotation member, and a second portion partially received in said central bore of said first receptacle and said aperture of said rotation member.

12. The holder as claimed in 11, wherein said fastener is installed in said second portion of said stopper, for fastening the assembly between said first receptacle, said rotation member, and said second receptacle.

13. The holder as claimed in claim 12, said fastener is provided with a thread region engaging with said second portion of said stopper, wherein the longer the threaded region between said fastener and said second portion of said stopper engaging, the smaller the adjustable cavity defined by said plate of said rotation member and said plateau of said first receptacle.

14. The holder as claimed in claim 2, wherein the plurality of crests and troughs are alternately arranged and radially formed continuously around said central aperture of said rotation member.

15. The holder as claimed in claim 2, wherein said stopper comprising a first portion and a second portion partially received in said central bore of said first receptacle and said aperture of said rotation member.

16. The holder as claimed in claim 2, said rod member comprising:

a first hollow rod;

a second hollow rod, wherein the inner diameter of said second hollow rod is smaller than the inner diameter of said first hollow rod;

a connector, comprising a first portion having sized and shaped to fit the internal cavity of said first hollow rod, and a second portion having sized and shaped to fit the internal cavity of said second hollow rod;

wherein said connector and said second hollow rod are disposed inside the internal cavity of said first hollow rod, and said second hollow rod connected to said second portion of said connector.

17. The holder as claimed in claim 16, wherein said second hollow rod is received by said stopper and said first hollow rod is received by said rotation member.

18. The holder as claimed in claim 2, wherein said base member is provided with an auxiliary arm member having a stick and a pad, wherein said auxiliary arm member is configured to slant towards said rod member.

19. The holder as claimed in claim 2, wherein said rod member can be equipped with an enhancer that can be sleeved over the outer surface of said rod member, wherein said enhancers is designed to provide a plurality of edges or ridges bulging outwards from the rod member and/or spirally circulating around said rod member.

20. A holder, for rolled paper products, comprising:

a base member, comprising:

a compartment;

a first receptacle, fixed to said compartment, comprising a central bore;

one spring disposed in said first receptacle and being coaxial with said central bore of said first receptable;

a disc disposed on said spring, comprising: at least one ramp protruding therefrom facing away said resilient member; and a central aperture being coaxial with said central bore of said first receptable;

a rotation member having a complementary structure to the structure of said first receptacle, such that said rotation member fittingly assembling to said first receptacle can rotate with respect to said first receptacle, in which, said rotation member comprising: a central aperture superimposed to said central bore of said first receptacle, and a plurality of crests and troughs facing said ramp of said disc;

a stopper, partially received in said central bore of said first receptacle and said central aperture of said rotation member; and a fastener, for fastening said stopper to said first receptacle, wherein said stopper is profiled to maintain the assembled state of said rotation member to said first receptacle; and a rod member, contacting said rotation member.

* * * * *